United States Patent [19]

Chee

[11] Patent Number: 4,486,042

[45] Date of Patent: Dec. 4, 1984

[54] GATE LATCH

[76] Inventor: Jeffrey Chee, 118-65 Metropolitan Ave., Queens, N.Y. 11415

[21] Appl. No.: 402,127

[22] Filed: Jul. 26, 1982

[51] Int. Cl.[3] ..... E05B 15/02; E05C 19/10

[52] U.S. Cl. ..... 292/246; 292/304; 292/341.17

[58] Field of Search ..... 292/246, 304, 341.17, 292/300, 302, 303; 160/155-161

[56] References Cited

U.S. PATENT DOCUMENTS

| | | | |
|---|---|---|---|
| 290,931 | 12/1883 | Reynolds et al. | 292/302 |
| 655,991 | 8/1900 | Ralph | 292/300 |
| 1,341,592 | 5/1920 | Ruehle | 292/304 |
| 1,646,696 | 10/1927 | Keays et al. | 292/304 |
| 1,750,066 | 3/1930 | Stripling | 160/161 |
| 2,637,576 | 5/1953 | Nottingham | 292/246 |
| 3,600,032 | 8/1971 | Gross | 292/304 X |
| 4,061,371 | 12/1977 | Prather et al. | 292/304 X |

FOREIGN PATENT DOCUMENTS

| | | | |
|---|---|---|---|
| 656522 | 5/1929 | France | 292/304 |
| 556587 | 10/1943 | United Kingdom | 292/246 |

*Primary Examiner*—Gary L. Smith
*Assistant Examiner*—Lloyd A. Gall
*Attorney, Agent, or Firm*—Arthur I. Degenholtz

[57] ABSTRACT

A latch apparatus for use with gates includes a latch bracket and a latch bar which removably engages and is locked to the latch bracket. The latch bracket includes a plurality of inclined slots which accept pins mounted on the latch bar and a catch member which is spring loaded to bear downward on the top portion of the latch bar when the latch bar is engaged in the latch bracket. To release the latch bar from the latch bracket, the catch member is swung away from the latch bar and the latch bar lifted so that the pins slide out of the slots in the latch bracket.

10 Claims, 6 Drawing Figures

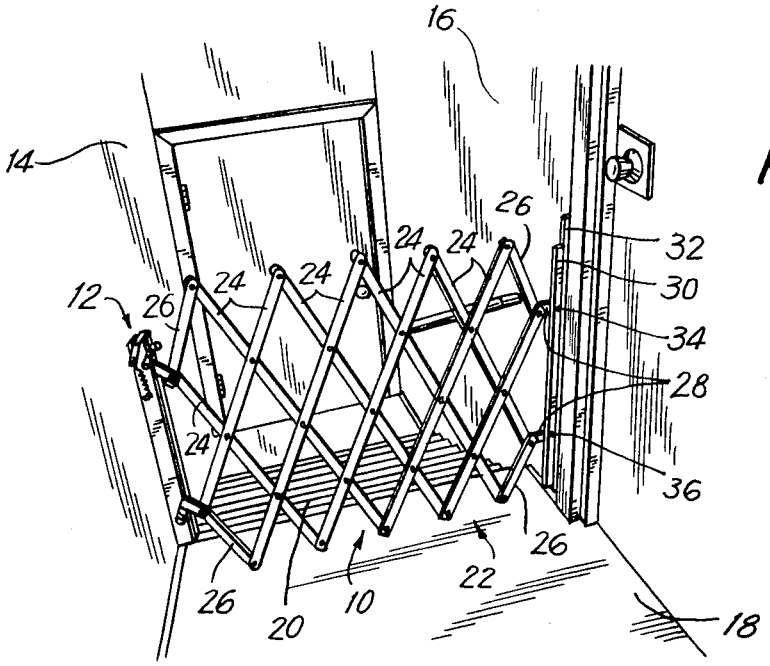
FIG. 1
FIG. 2
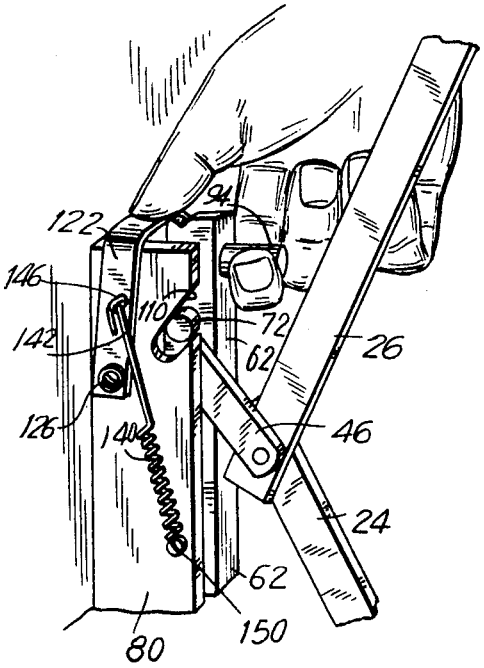
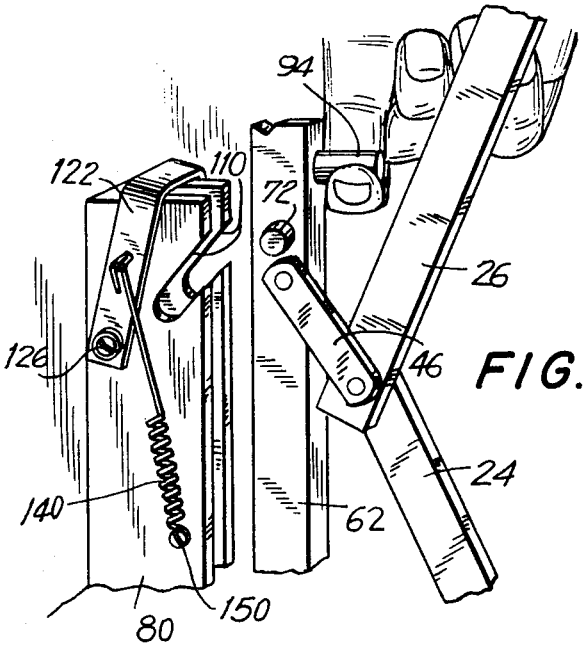
FIG. 3

GATE LATCH

BACKGROUND OF THE INVENTION

With the ever increasing attention to product safety and the prevention of accidents, especially accidents involving children, a need for an improved safety gate latch has become evident. Conventional safety gates used to prevent access of young children to stairways and other places of potential danger include a folding arrangement of bars and a simple latch device usually of the hook and eye type. The major deficiency of this type of gate is that children, even relatively young children, soon learn how to operate the latch and open the gate, thereby creating a dangerous situation. The conventional safety gate is objectionable because it creates in the mind of the child's parent or guardian an illusion of safety which can be more dangerous than not having a gate at all.

The conventional safety gate is also objectionable because the hook and eye latch device attaches the gate to only a single point on the wall, thus creating a condition wherein the hook and eye latch is usually mounted on the upper portion of the gate and the lower portion of the gate is not attached to the wall support structure. The operation of the conventional safety gate is generally clumsy and requires two hands: one hand to locate and operate the hook and eye latch and the other hand to grasp and operate the gate.

In order to be effective a safety gate requires a latch which combines the disparate requirements of having a construction and mode of operation which cannot be easily operated by a child yet can be easily and efficiently operated by an adult. The latch mechanism must be simple, reliable and foolproof, facilitating efficient operation by an adult even in the most trying emergency situations.

OBJECTS OF THE INVENTION

It is an object of the present invention to provide an improved latch apparatus which cannot be easily operated by a child yet can be easily operated by an adult.

Another object of the present invention is to provide a latch apparatus which can be opened and closed with one hand.

Another object of the present invention is to provide a latch apparatus which effectively secures a gate along its entire vertical edge.

Another object of the present invention is to provide a latch apparatus which is sufficiently strong so as to effectively prevent rupture or damage by a child.

Still another object of the present invention is to provide a latch apparatus which comprises a small number of relatively simple parts which are economical of manufacture resulting in a relatively low unit cost.

SUMMARY OF THE INVENTION

In accordance with the present invention there is provided a latch apparatus for use with gates which includes a latch bracket which, in use, is mounted to a wall or to an otherwise stationary structure and a latch bar which removably engages the latch bracket to lock the gate. The latch bracket includes a pair of spaced apart, parallel leg portions which are proportioned to accept the latch bar. The latch bracket has an upper and a lower pair of aligned slots formed in the leg portions and the latch bracket has four projecting pins which engage the slots. The slots are disposed at an angle in the order of 45 degrees with the longitudinal axis of the latch bracket so that when the pins of the latch bar are engaged in the slots of the latch bracket the latch bar can be withdrawn from the catch only by lifting the latch bar upwardly and outwardly.

A catch member is pivotally mounted on the latch bracket and is urged by a helical spring to bear downward against the top portion of the latch bar when the latch bar is mounted in the latch bracket. In order to open the latch apparatus, the catch member must be swung away from the latch bar and the latch bar must be lifted so that the pins on the latch bar slide out of the slots. This double action of swinging the catch member while lifting the latch bar, is simple for an adult to accomplish. However, it is extremely difficult for a child, thereby preventing unwanted opening of the latch apparatus by children.

BRIEF DESCRIPTION OF THE DRAWINGS

Additional objects and advantages of the present invention will become apparent during the course of the following specification when taken in connection with the accompanying drawings in which;

FIG. 1 is an overall perspective view of a safety gate apparatus which incorporates a latch apparatus according to the present invention with the safety gate shown installed on a landing at the edge of a flight of stairs;

FIG. 2 is a fragmentary perspective view showing an operator starting to open the latch apparatus shown in FIG. 1;

FIG. 3 is a fragmentary perspective view similar to FIG. 2 showing the operator completing the operation of opening the latch apparatus;

DETAILED DESCRIPTION OF THE INVENTION

Figure 4:
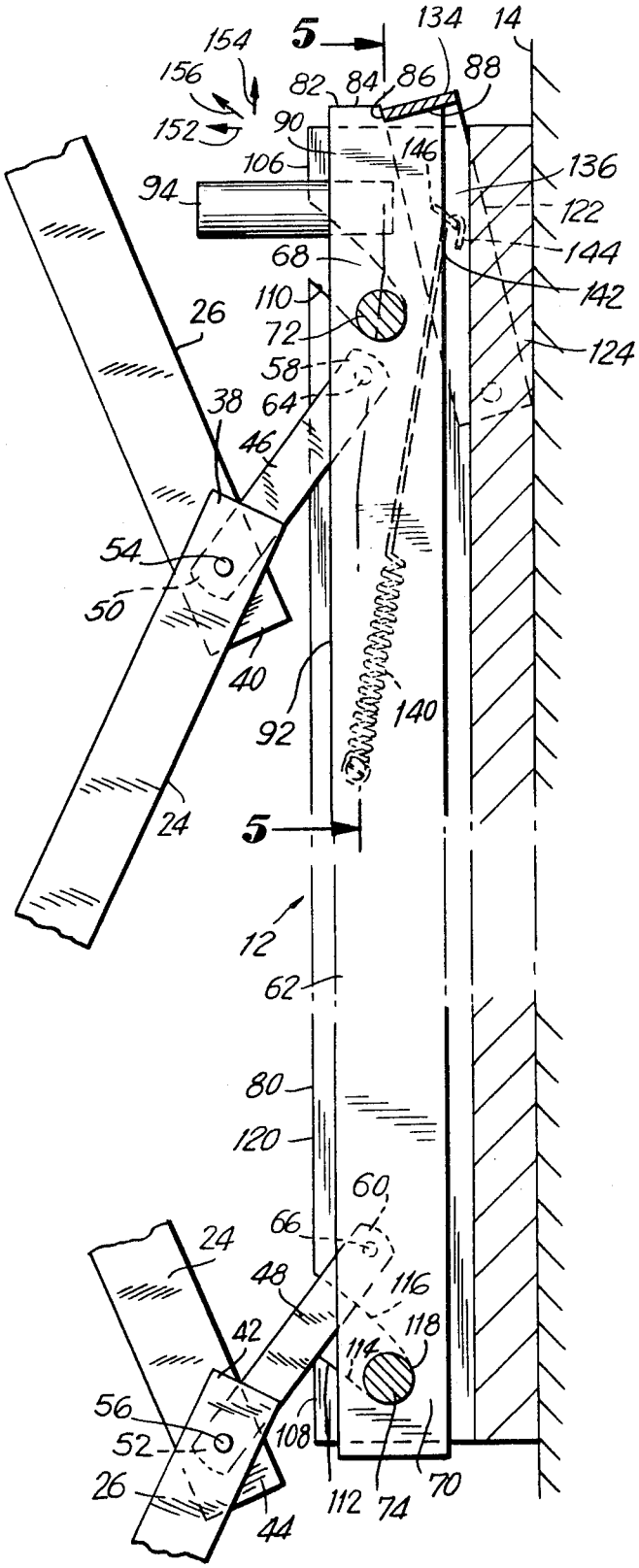
FIG. 4 is a side elevational view of the latch apparatus of FIG. 1.

With reference to the drawings there is shown in FIG. 1 a safety gate 10 which incorporates a latch apparatus 12 made in accordance with the present invention. The safety gate 10 is shown mounted on the walls 14,16 of a stairway at the edge of a landing 18 and, the safety gate 10 prevents a child who may be on the landing 18 from falling down the stairs 20.

The safety gate 10 comprises a folding gate assembly 22 and the latch apparatus 12. The folding gate assembly 22 includes a plurality of bars 24,26 which are pivotally connected to form a parallel-action mechanism. The folding gate assembly 22 is conventional in nature and need not be described in detail. The ends 28 of the folding gate assembly 22 are pivotally connected to the bars 30,32 by means of the pivots 34,36. The bars 30,32 are attached to the wall 16 using conventional means such as screws or the like, which are not shown.

Figure 5:
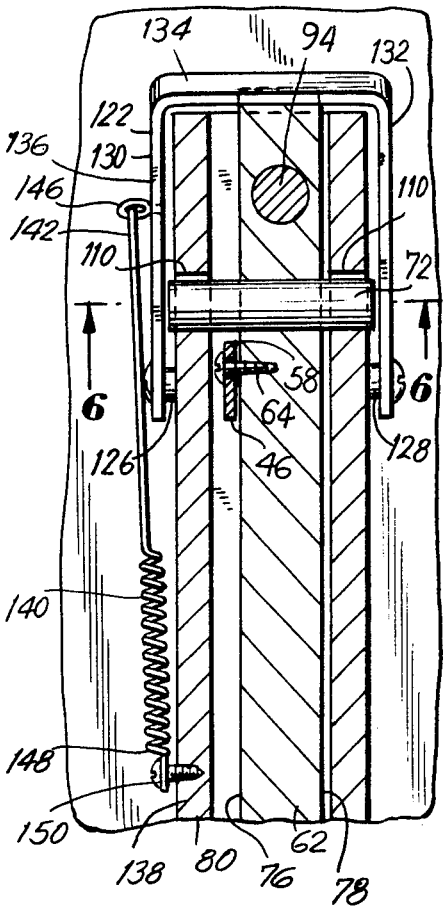
FIG. 5 is a fragmentary cross-sectional view taken along the line 5—5 of FIG. 4.
Figure 6:
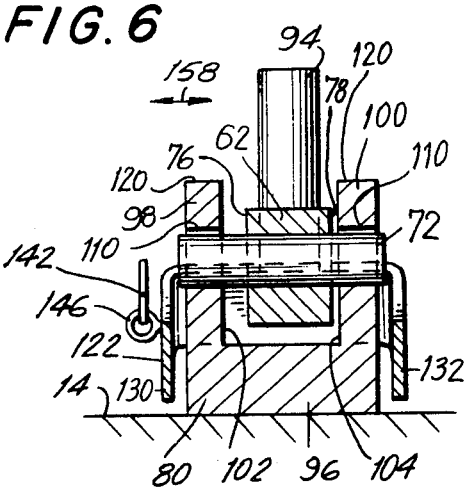
FIG. 6 is a cross-sectional view taken along the line 6—6 of FIG. 5.

As is best shown in FIG. 4, the ends 38,40,42,44 of the bars 24,26 of the folding gate assembly 22 are connected to the latch apparatus 12 by means of a pair of relatively short links 46,48, the ends 50,52 of which are connected to the bars 24,26 by means of pivots 54,56. The ends 58,60 of the links 46,48 are connected to a latch bar 62 by means of pivots 64,66. The upper 68 and lower 70 portions of the latch bar 62 each have a horizontally disposed pin 72,74 which passes through the latch bar 62 and projects beyond the sides 76,78 of the latch bar 62 as is best shown in FIGS. 5 and 6. The latch bar 62 cooperates with a latch bracket 80 in a manner which will be presently described. The upper surface 82 of the latch bar 62 has a horizontal portion 84 and a pair of intersecting potions 86,88 forming a notch. The upper portion 90 of the surface 92 of the latch bar 62 has a projecting peg 94 which may be used by an operator to move the latch bar 62 in a manner which will be presently described.

The latch bracket 80 has a back portion 96 which may be fastened to the wall 14 as is shown in FIG. 6 using conventional fastener means such as screws, which are not shown, and a pair of opposed, spaced apart parallel leg portions 98,100. The space between the inner surfaces 102,104 of the leg portions 98,100 is proportioned to accept the latch bar 62. The upper 106 and lower 108 portions of the leg portions 98,100 each have a pair of aligned slots 110,112 which cooperate with the projecting pins 72,74 in a manner which forms a major novel feature of the present invention. The slots 110,112 are each identical in configuration and only the slots 112 will therefore be described in detail. The slots 112 each include a pair of inclined side wall portions 114,116 and a curved bottom wall 118. The space between the side wall portions 114,116 is proportioned to accept the projecting pins 72,74 and the radius of curvature of the bottom wall 118 is equal to that of the projecting pins 72,74 enabling the projecting pins 72,74 to easily enter and lodge in the slots 110,112. The included angle between the inclined walls 114,116 and the surfaces 120 of the leg portions 98,100 is in the order of 45 degrees and once the projecting pins 72,74 enter the slots the pins slide downward to the bottom of the slots 110,112 and the latch bar 62 is held securely in the latch bracket 80.

A catch member 122 is mounted on the upper portion 124 of the latch bracket 80 by means of a pair of pivots 126,128. The catch member 122 includes a pair of generally vertical legs 130,132 which are joined by a generally horizontal portion 134 with the catch member 122 thus having the general configuration of an inverted capital letter U. An intermediate portion 136 of the leg 130 is connected to a portion 138 of the leg 98 by means of a helical tension spring 140. The upper end 142 of the tension spring 140 has a hook 144 which passes through an eye which is mounted on the leg 130. The lower end 148 of the tension spring 140 is attached to the leg 98 by means of a pivot 150 which is mounted below and to the right of the pivot 150 when viewed as in FIGS. 2 and 3. The catch member 122 is preferably formed as a unitary member by bending a length of stock having a rectangular cross section. The tension spring 140 is disposed to pull on the leg 130 thereby rotating the catch member 122 in a clockwise direction, when viewed as in FIG. 3 until the horizontal portion 134 rests on the upper surfaces 86,88 of the latch bar 62.

Although in the locked position the latch bar 62 is held securely as has been described. To open the latch apparatus 10 an operator need only grasp the peg 94 which projects from the latch bar 62, swing the catch member away from the top surface 86,88 of the latch bar 62 as is shown in FIG. 2, and pull upward on the peg 94 causing the pins 72,74 to ride upward and then out of the slots 110,112 as is shown in FIG. 3.

When the latch apparatus 12 is in the locked position the latch bar 62 is positioned between the leg portions 98,100 of the latch bracket 80 as is shown in FIGS. 4, 5 and 6 and the pins 72,74 are engaged in the slots 110,112. The horizontal portion 134 of catch member 122 is caused by the tension spring 140 to bear against the surfaces 86,88 of the latch bar 62 holding the latch bar 62 firmly in place. As is shown in FIG. 4, a child pulling on the latch bar 62 in a horizontal direction shown by the arrow 152, a vertical direction shown by the arrow 154 or an inclined direction shown by the arrow 156 finds that the latch bar 62 is held securely by the catch member 122. Pulling or pushing on the gate 10 in the direction shown by the arrow 158 in FIG. 6 causes the latch bar 62 to bear against the legs 98,100 of the latch bracket 80 preventing release of the latch bar 62.

To lock the latch apparatus 12 the operator guides the latch bar 62 between the legs 98,100 of the latch bracket 80 and guides the pins 72,74 into the slots 110,112. By pushing the latch bar 62 downward, the pins 72,74 ride to the bottom of the slots 110,112 and the catch member 122 overrides the top 82 of the latch bar 62 and again holds the latch bar 62 in place as is shown in FIG. 4. Alternatively, the catch member 122 can be swung out of the way of the latch bar 62 by hand and then released once the latch bar 62 is in place.

The latch apparatus 12 according to the present invention has been described with reference to a folding type safety gate 10 used to limit the access of children to various areas considered dangerous or unsuitable. This has been done by way of example only and it is clear that the latch apparatus may be used with a wide variety of gates of various types and sizes.

While a preferred embodiment of the invention has been shown and described herein, it is obvious that numerous additions, changes and omissions may be made in such embodiment without departing from the spirit and scope of the invention.

What is claimed is:

1. A latch apparatus comprising a latch bracket having a pair of spaced apart opposed leg portions with at least one of said leg portions having at least one slot, a latch bar proportioned to enter between said leg portions, with said latch bar having an upper end projecting above said with said latch bar having an upper end projecting above said latch bracket, a projecting pin mounted on said latch bar and disposed to enter said slot when said latch bar enters between said leg portions, catch means pivotally mounted on said latch bracket capable of a first position overlying said upper end of said latch bar, and spring means connecting said catch means and said latch bracket and urging said catch means toward said first position.

2. A latch apparatus according to claim 1 in which said spring means comprises a helical tension spring.

3. A latch apparatus according to claim 1 in which said catch means comprises a unitary member having a pair of spaced apart leg portions, having lower ends pivotally mounted on said latch bracket and having upper ends joined by a connecting portion with said connecting portion disposed to overlie and bear against said upper end of said latch bar.

4. A latch apparatus according to claim 3 in which said spring means is connected to an intermediate portion of one of said catch means leg portions.

5. A latch apparatus according to claim 1 in which said upper end of said latch bar includes a notched portion proportioned to accept said catch means.

6. A latch apparatus according to claim 1 further including a handle mounted on said latch bar.

7. A latch apparatus according to claim 1 in which said latch bracket has a longitudinal axis and said slot forms an angle in the order of 45 degrees with said longitudinal axis.

8. A latch apparatus according to claim 1 in which each of said leg portions has a slot with said slots in alignment, and with said latch bar having a pair of projecting pins disposed for alignment with said slots.

9. A latch apparatus according to claim 1 in which said leg portions each have upper and lower portions, with upper portions of said leg portions each having a slot, with said slots on opposed leg portions in alignment, and with said lower portions of said leg portions each having a slot; with said slots on opposed leg portions in alignment, and further comprising four projecting pins mounted on said latch bar and disposed for engagement with said slots on said latch bracket.

10. A latch apparatus according to claim 1 in which said leg portions on said latch bracket are parallel.

* * * * *